US005554095A

United States Patent [19]

Matsuo

[11] Patent Number: 5,554,095

[45] Date of Patent: Sep. 10, 1996

[54] BIAS TAPE MAKER

[75] Inventor: Yoshimi Matsuo, Osaka, Japan

[73] Assignee: Clover Manufacturing Co. Ltd., Osaka, Japan

[21] Appl. No.: 330,742

[22] Filed: Oct. 28, 1994

[30] Foreign Application Priority Data

Jul. 15, 1994 [JP] Japan ..... 6-164013

[51] Int. Cl.[6] ..... B65H 45/22

[52] U.S. Cl. ..... 493/440; 493/455; 493/456; 493/468

[58] Field of Search ..... 493/438–440, 493/455, 456, 468

[56] References Cited

U.S. PATENT DOCUMENTS

| | | | |
|---|---|---|---|
| 891,730 | 6/1908 | Pitcher | 493/456 |
| 1,018,227 | 2/1912 | Althen | 493/456 |
| 2,712,933 | 7/1955 | Davidson | 493/455 |
| 2,952,766 | 4/1952 | Tincher | 493/455 |
| 2,956,799 | 10/1960 | Wasson | 493/439 |
| 4,298,148 | 11/1981 | Gakiya | 493/440 |

FOREIGN PATENT DOCUMENTS

| | | | |
|---|---|---|---|
| 2049548 | 1/1983 | United Kingdom | B65H 45/08 |

*Primary Examiner*—Jack W. Lavinder
*Attorney, Agent, or Firm*—Michael D. Bednarek; Kilpatrick & Cody

[57] ABSTRACT

A bias tape maker comprises a thin walled outer member and an inner core member fitted in the outer member. The outer member includes a bottom wall, a pair of side walls extending upright from the bottom wall, and a pair of roof margins bent toward each other. Further, the outer member has a tape entry opening and a tape exit slit. The inner core member has a pair of longitudinal grooves for receiving the pair of roof margins. A tape guide passage is formed between the outer member and the inner member to extend from the tape entry opening of the outer member to the tape exit slit. The tape guide passage includes a tape folding portion adjoining the tape exit opening. The bottom wall of the outer member is formed with a tape advancing slot extending longitudinally between the tape entry opening and the tape exit slit.

11 Claims, 8 Drawing Sheets

BIAS TAPE MAKER

BACKGROUND OF THE INVENTION

1. Field of the Invention

This invention relates to a device for making a bias tape which is a narrow strip of cloth having a pair of longitudinal margins folded toward each other for use chiefly in finishing, streightening and decorating clothing. Such a device is referred to as a bias tape maker.

2. Description of the Related Art

A typical bias tape maker is known from UK Patent No. 2049548 for example and has such a structure as shown in FIGS. 17 and 18 of the accompanying drawings. Specifically, the typical bias take maker mainly comprises two parts which include an outer tubular member 51 and an inner core member 52. The outer tubular member 51 may be formed by punching a thin metal sheet, followed by bending the punched sheet into a tubular shape. The inner core member 52 may be formed of a resin by molding.

The inner core member 52 tapers from its rear end to its front end and has a generally triangular platform 53 which is formed with a pair of longitudinal engaging grooves 54. The outer tubular member 51 has a pair of roof margins 55 received in the pair of longitudinal engaging grooves 54 when the outer member 51 is assembled with the inner core member 52. Further, in the assembled state, a tape folding passage (not specifically shown) is formed between the outer member 51 and the inner core member 52.

The platform 54 of the inner core member 52 is pivotally connected, at its rear end, to two ends 57*a* of a holder ring 57. Further, the platform 54 is formed with a tape advancing slot 58 which penetrates through the thickness of the inner core member 52.

In use, a material tape 56 is introduced into the tape folding passage of the bias tape maker from the rear end thereof. However, due to friction which increases toward the front end of the bias tape maker, it is difficult to manually insert the material tape 56 (which is inherently flexible) to the extent of causing its leading edge to project beyond the front end of the bias tape maker. Thus, a needle-like rod need be inserted into the tape advancing slot 58 of the inner core member 52 for engagement with the material tape 56. Usually, the needle-like rod in engagement with the material tape 56 is moved forward two or three times before the leading edge of the material tape 56 starts projecting out of the bias tape maker.

Upon progressive passage through the bias tape maker, the material tape 56 is continuously formed into a bias tape 56*x* having a pair of folds 56*a*. The folds 56*a* may be fixed or set by ironing.

According to the prior art described above, since the tape advancing slot 58 is formed with a relatively small width in the inner core member 52 which is relatively thick, a user's finger cannot make direct access to the material tape 56 through the slot 58 for preliminary advancing thereof. Therefore, it is rather inconvenient and inefficient to use the prior art bias tape maker. Further, the the needle-like rod must always accompany the prior art bias tape maker, which fact is another disadvantage of the prior art.

SUMMARY OF THE INVENTION

It is, therefore, an object of the present invention to provide a bias tape maker with which it is possible to conveniently perform a preliminary step of inserting a material tape until its leading edge projects beyond the front end of the bias tape maker.

According to the present invention, there is provided a bias tape maker comprising: a thin walled outer member including a bottom wall, a pair of side walls extending upright from the bottom wall, and a pair of roof margins bent toward each other, the outer member having a tape entry opening and a tape exit slit; and an inner core member fitted in the outer member and having a pair of longitudinal grooves for receiving the pair of roof margins; wherein a tape guide passage is formed between the outer member and the inner member to extend from the tape entry opening of the outer member to the tape exit slit, the tape guide passage including a tape folding portion adjoining the tape exit opening; and wherein the bottom wall of the outer member is formed with a tape advancing slot extending longitudinally between the tape entry opening and the tape exit slit.

Preferably, the tape advancing slot may be longitudinally offset toward the tape exit slit of the outer member.

The inner core member may have a larger width portion immediately below the pair of longitudinal grooves, and a smaller width portion immediately below the larger width portion. Advantageously, the larger width portion provides a pair of downwardly facing steps each of which extends more than half the length of the inner core member from the tape entry opening of the outer member. Further, each of the steps may be preferably rounded at the tape entry opening of the outer member.

Typically, the outer member is tapered from the tape entry opening to the tape exit slit. In this case, the inner core member may preferably have a platform raised above the pair of roof margins of the outer member. The platform may be flat and substantially horizontal or slightly inclined upwardly toward the tape exit end of the outer member. In either case, the platform may be formed with a multiplicity of transverse ridges.

Alternatively, the platform may be curved upwardly toward the tape exit slit of the outer member.

Further, the platform may be omitted, and the inner core member may be made to have an entirely flat upper surface.

Other objects, features and advantages of the present invention will become apparent from the following detailed description given with reference to the accompanying drawings.

DETAILED DESCRIPTION OF THE PREFERRED EMBODIMENTS

Figure 1:
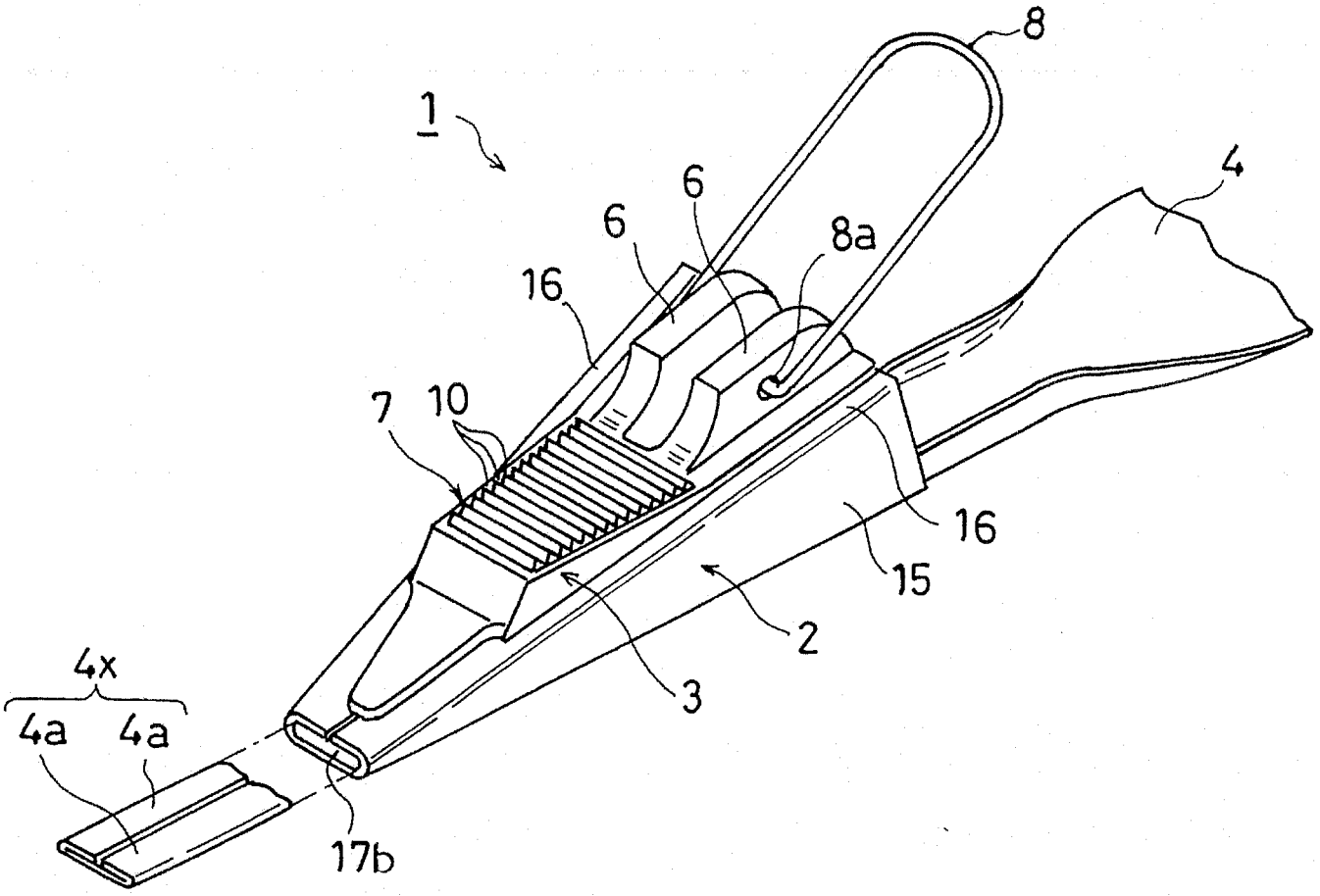
FIG. 1 is a perspective view showing the top side of a bias tape maker embodying the present invention.
Figure 2:
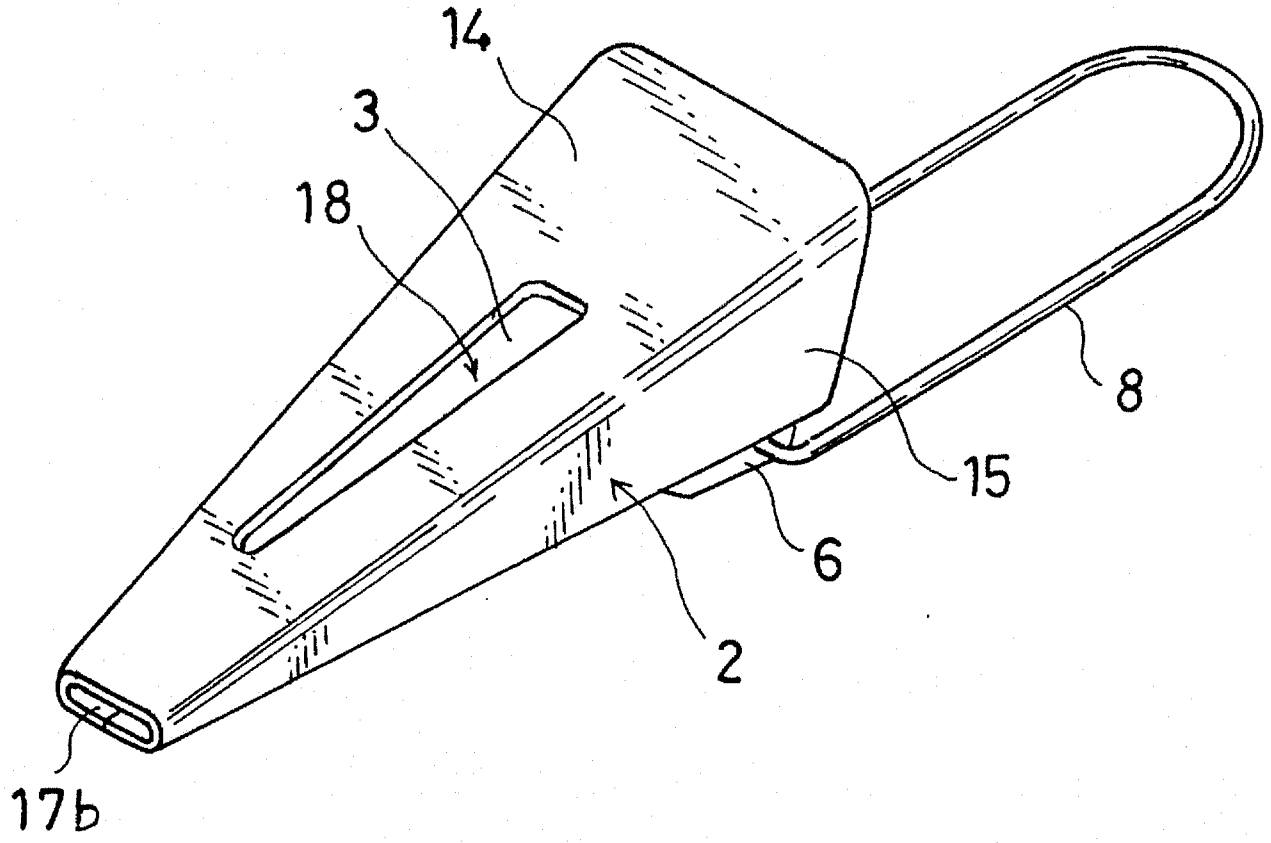
FIG. 2 is a perspective view showing the bottom side of the same bias tape maker.

Referring to FIGS. 1 and 2 of the accompanying drawings, there is illustrated a bias tape maker according to an embodiment of the present invention. The bias tape maker represented by reference numeral 1 mainly comprises two parts which include an outer tubular member 2 and an inner core member 3. The outer tubular member 2 may be formed by punching a thin metal sheet, followed by bending the punched sheet into a tubular shape. The inner core member 3 may be formed of a resin by molding.

Figure 3:
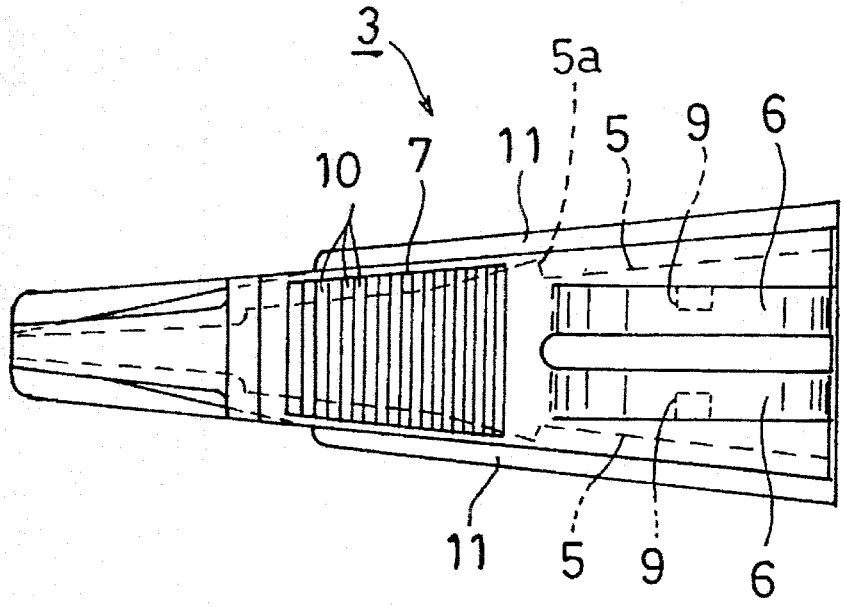
FIG. 3 is a plan view showing an inner core member which is one component of the bias tape maker.
Figure 4:
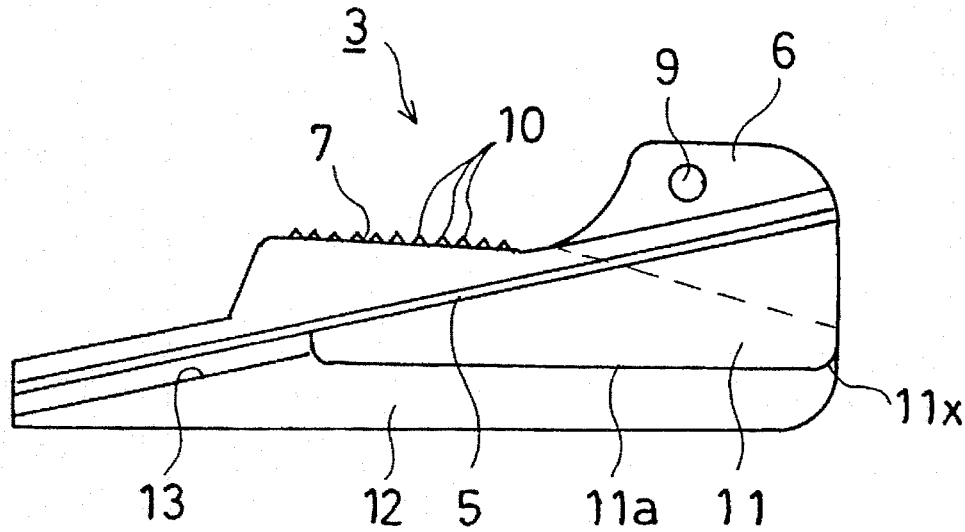
FIG. 4 is a side view showing the core member.

As shown in FIGS. 3 and 4, the inner core member 3, which tapers from its rear end to its front end, has a pair of side surfaces each of which is provided with a longitudinal engaging groove 5 inclined forwardly downward. The engaging groove 5 has, at an intermediate portion thereof, a snap projection 5*a*. The the core member 3 is provided, on its top and close to its rear end, with a pair of longitudinal projections 6. Further, the top of the core member 3 is provided, at an intermediate portion, with a platform 7 which is substantially flat and horizontal.

Each of the longitudinal projections 6 is formed with an engaging hole 9 for pivotally receiving a corresponding end 8*a* of a generally U-shaped holder ring 8 (see FIG. 1). The engaging hole 9 may be a through-hole. The platform 7 is formed with a multiplicity of minute ridges 10 extending transversely of the core member 3. The ridges 10 may have a height of about 0.3 mm and spaced from each other at an interval of about 1 mm for example.

Below the longitudinal engaging grooves 5, the inner core member 3 has a larger width portion 11 closer to the engaging grooves 5, and a smaller width portion 12 farther from the engaging grooves. The larger width portion 11 provides a pair of longitudinal steps 11*a* each of which extends more than half the length of the inner core member 3 and is rounded at its rear end 11*x*. The smaller width portion 12 is provided with a pair of inclined folding guide surfaces 13 adjacent to the front end of the core member 3 and immediately below the engaging grooves 5.

Figure 5:
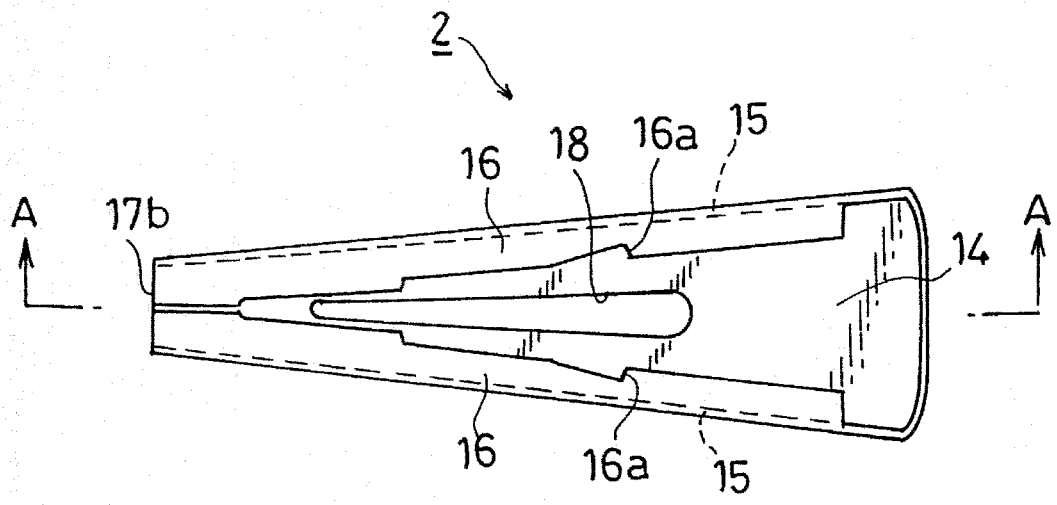
FIG. 5 is a plan view showing an outer tubular member which is another component of the bias tape maker.
Figure 6:
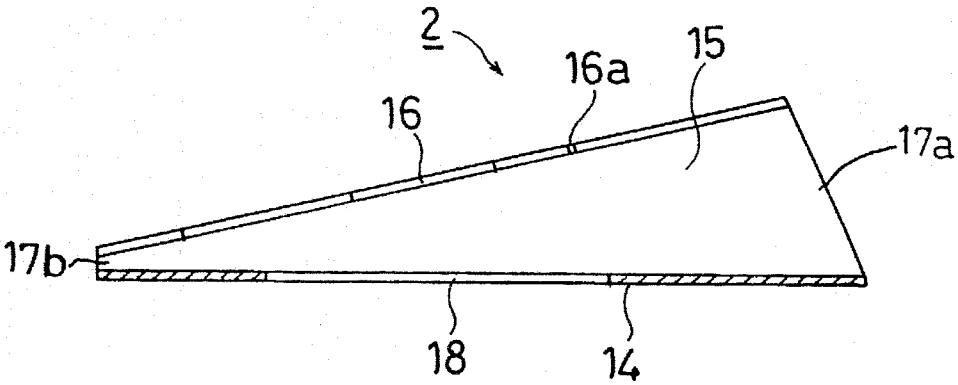
FIG. 6 is a sectional view take on lines A—A in FIG. 5.
Figure 7:
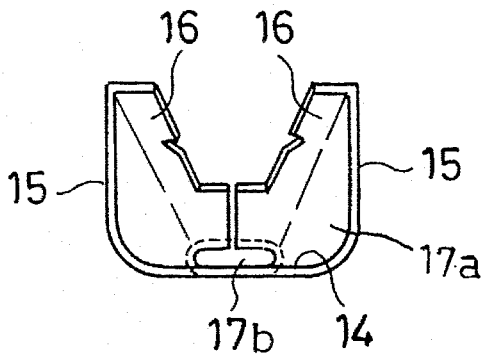
FIG. 7 is a rear view of the outer tubular member.

On the other hand, as shown in FIGS. 5 through 7, the outer tubular member 2 has a bottom wall 14, a pair of side walls 15 extending upright from the bottom wall, and a pair of roof margins 16 bent at the respective side walls 15 toward each other. The outer member 2 tapers from its rear end to its front end to provide a larger rear opening (tape entry opening) 17*a* and a smaller front opening or slit (tape exit slit) 17*b*. Further, each of the roof margins 16 is formed with an engaging notch 16*a* for snapping engagement with the engaging projection 5*a* of a corresponding longitudinal groove 5 (see FIG. 3) when the inner core member 3 is fitted to the outer tubular member 2, thereby preventing the core member 3 from slipping off.

As better shown in FIGS. 2 and 5, the bottom wall 14 of the outer tubular member 2 is formed with a tape advancing slot 18. The function of the tape advancing slot 18 will be described hereinafter.

Figure 8:
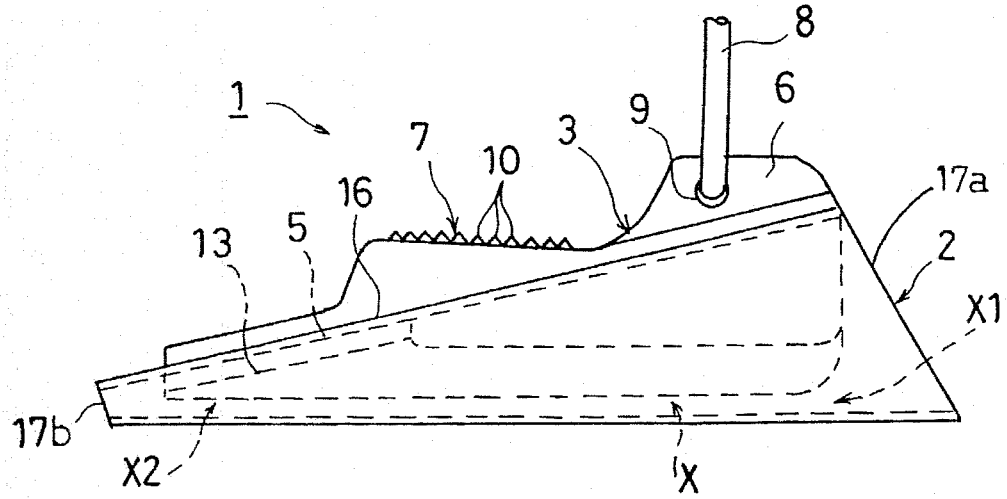
FIG. 8 is a side view showing the same bias tape maker.
Figure 9:
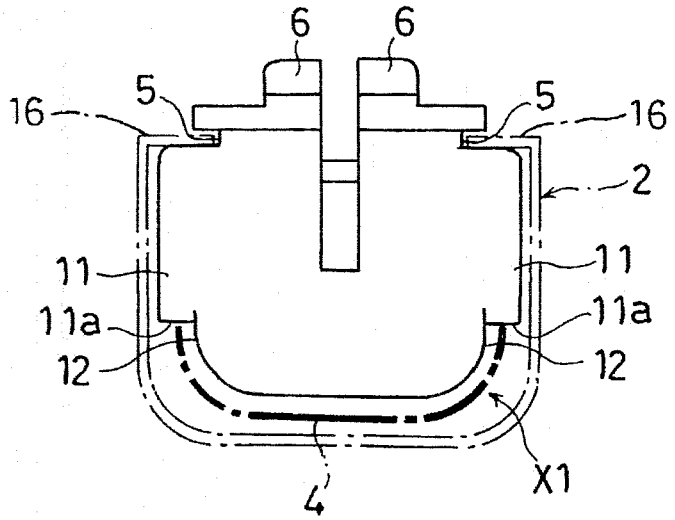
FIG. 9 is a rear view of the same bias tape maker.
Figure 10:
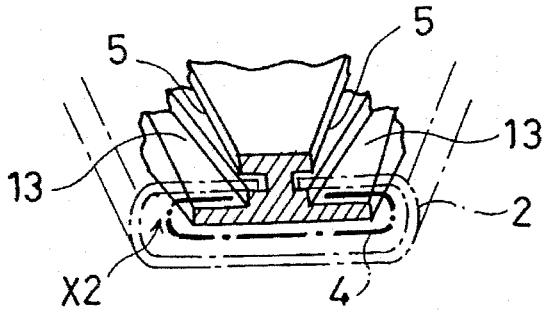
FIG. 10 is an enlarged fragmentary perspective view showing a front portion of the bias tape maker.

When assembled, the roof margins 16 of the outer tubular member 2 fits snugly in the longitudinal grooves 5 of the inner core member 3, as shown in FIGS. 8 through 10. In this assembled state, a tape guide passage X is formed between the smaller width portion 12 of the inner core member 3 and the outer tubular member 2. Specifically, the tape guide passage X comprises a tape inserting portion X1 defined under the larger width portion 11 of the inner core member 3 and extending from the tape entry opening 17*a* of the outer tubular member 2, and a tape folding portion X2 extending from the tape inserting portion X1 to the tape exit slit 17*b* of the outer tubular member 2. The tape folding portion X2 of the tape guide passage X is partially defined by the respective inclined folding guide surfaces 13 of the inner core member 3.

Figure 17:
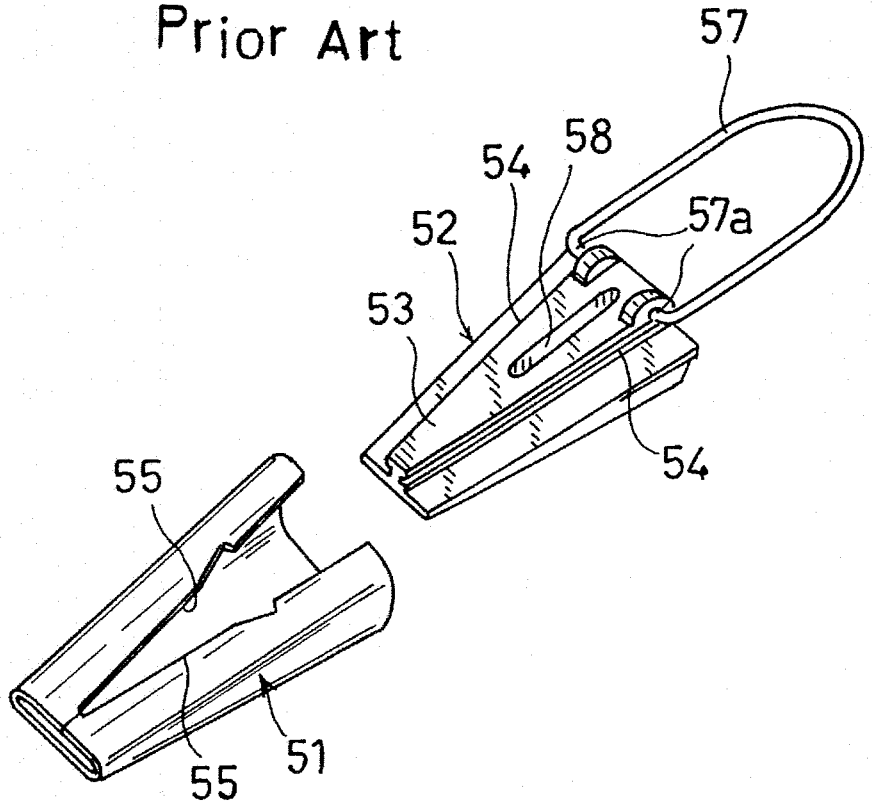
FIG.17 Prior Art
FIG. 17 is a perspective view showing a prior art bias tape maker in an exploded state.
Figure 18:
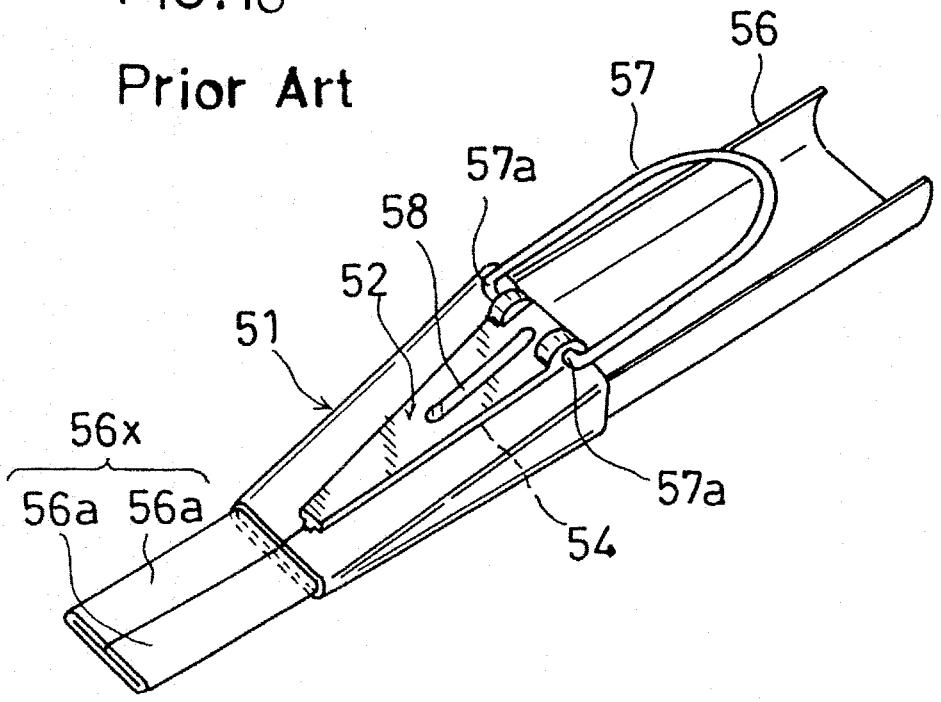
FIG.18 Prior Art
FIG. 18 is a perspective view showing the same prior art bias tape maker in an assembled state.

The bias tape maker 1 described above may be used in the same way as the prior art bias tape maker shown in FIGS. 17 and 18. Specifically, a material tape 4 is first introduced into the tape inserting portion X1 of the tape guide passage X from the tape entry opening 17*a* of the outer tubular member 2, as shown in FIG. 9.

Then, the material tape 4 is advanced until the leading edge of the material tape 4 projects out from the tape folding portion X2, as shown in FIG. 1. At this time, the tape advancing slot 18 of the outer tubular member 2 is utilized for enabling a user's finger to make access to the material tape 4, thereby facilitating the advance of the material tape 4 through the tape folding portion X2. Alternatively, the user may use a short engaging article (not shown) for advancing the material tape 4 by utilizing the tape advancing slot 18.

Finally, the material tape 4 is pulled out until the entirety of the material tape 4 leaves the tape folding portion X2 of the bias tape maker 1. As a result, the material tape 4 is formed into a bias tape 4*x* which has a pair of folds 4*a*, 4*b* , as shown in FIG. 1. The folds 4*a*, 4*b* may be fixed or set by ironing as the tape 4*x* is pulled out.

The pulling of the tape 4 (or 4*x*) may be performed by manually nipping the holder ring 8 with the user's thumb held against the ridged platform 7. Apparently, the ridges 10 of the platform 7 prevent an unexpected slit between the user's thumb and the platform 7, so that the bias tape maker 1 can be held in a fixed position even if the tape 4 (or 4*x*) is forcibly pulled.

According to the embodiment described above, the tape advancing slot 18 is formed in the bottom wall 14 of the outer tubular member 2 which is made of a thin metal plate. Thus, the tape advancing slot 18 provides an easy access to the material tape 4 for preliminary advancing thereof. Therefore, unlike the prior art shown in FIGS. 17 and 18, it is unnecessary to use a relatively long article for preliminary advancing of the tape, thereby facilitating the job of making a bias tape.

Further, as shown in FIG. 5, the tape advancing slot 18 is slightly offset longitudinally toward the tape exit slit 17*b* of the outer tubular member 2. Such an offset arrangement of the tape advancing slot 18 makes it possible to advance the leading edge of the material tape 4 beyond the tape exit slit 17*b* by a single advancing stroke. By contrast, if the tape advancing slot 18 is offset toward the tape entry opening 17*a* (as is the case with the prior art shown in FIGS. 17 and 18), it may be necessary to perform two or more advancing strokes until the leading edge of the tape 4 advances past the tape exit slit 17*b*.

Moreover, the bias tape maker 1 according to the above embodiment has the following additional advantages.

First, as shown in FIG. 8, the ridged platform 7 is substantially horizontal to be raised above the roof margins 16 of the outer tubular member 2 which is tapered toward the front end. Thus, even if the ironing heat is transmitted to the outer tubular member 2 at the time of setting the folds 4*a*, 4*b* of the tape 4*x*, the user's thumb pressing against the platform 7 is prevented from suffering adverse influences of the transmitted ironing heat.

Secondly, as shown in FIG. 9, the longitudinal steps 11*a* provided by the larger width portion 11 of the inner core member 3 extend more than half the length of the inner core core member 3 to effectively prevent the material tape 4 from localizing sidewise, so that the material tape 4 is reliably formed into a proper bias tape. Further, the rounded rear end 11*x* (see FIG. 4) of each longitudinal step 11*a* ensures smooth tape feed.

The inner core member 3 may be modified variously in configuration. FIGS. 11 through 16 show several examples of modification. In these figures, the parts corresponding to those of the above-described embodiment are designated by the same reference signs as used in FIGS. 1 through 10.

Figure 11:
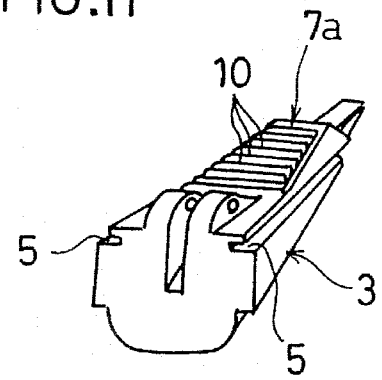
FIGS. 11 through 16 are perspective views showing modified inner core members.

In a first modification shown in FIG. 11, an inner core member 3 is made to have a ridged platform 7*a* which is flat but inclined forwardly upward. This modification is advantageous in that the ridged platform 7*a* provides even better slip prevention relative to the user's thumb.

Figure 12:
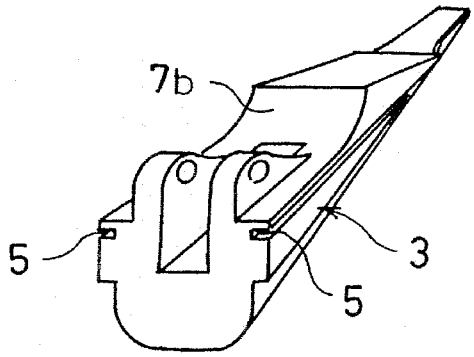

In a second modifiction shown in FIG. 12, an inner core member 3 is made to have a non-ridged platform 7*b* which is curved forwardly upward. This modification is advantageous in the simplicity of molding the core member 3 while the curved platform 7*b* provides sufficient slip prevention relative to the user's thumb.

Figure 13:
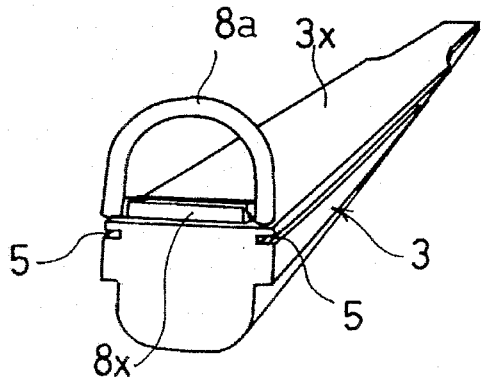

In a third modification shown in FIG. 13, an inner core member 3 is made to have an entirely flat upper surface 3*x* which is inclined forwardly downward. Further, a holder ring 8*a* is rendered relatively small and has a transverse shaft portion 8*x* pivotally connected to the rear end of the inner core member 3.

Figure 14:
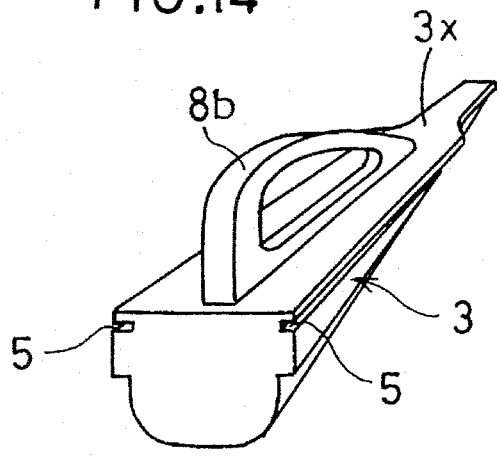

In a fourth modification shown in FIG. 14, an inner core member 3 is also made to have an entirely flat upper surface 3*x* which is inclined forwardly downward and formed integrally with a holder 8*b*.

Figure 15:
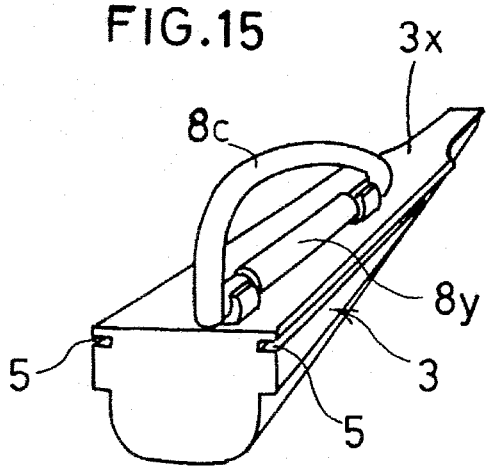

In a fifth modification shown in FIG. 15, an inner core member 3 has an entirely flat upper surface 3*x* which is inclined forwardly downward. Further, a holder 8*c* has a longitudinal shaft portion 8*y* which is pivotally connected to the upper surface 3*x*.

Figure 16:
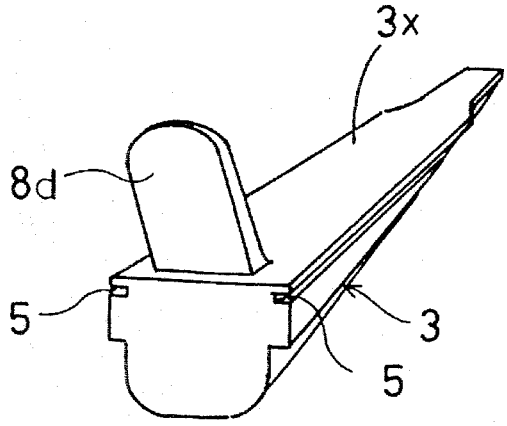

In a sixth modification shown in FIG. 16, an inner core member 3 again has an entirely flat upper surface 3*x* which is inclined forwardly downward and integrally formed with a holder tongue 8*d*.

Apparently, the modifications shown in FIGS. 13–16 are equally advantageous in the simplicity of molding the inner core member 3.

The present invention being thus described, it is obvious that the same may be varied in many ways. Such variations are not to be regarded as a departure from the spirit and scope of the present invention, and all such variations as would be obvious to those skilled in the art are intended to be included within the scope of the following claims.

I claim:

1. A bias tape maker comprising:

a thin walled outer member including a bottom wall, a pair of side walls extending upright from the bottom wall, and a pair of roof margins bent toward each other, the outer member having a tape entry opening and a tape exit slit, the outer member being tapered from the tape entry opening to the tape exit slit; and an inner core member fitted in the outer member and having a pair of longitudinal grooves for receiving the pair of roof margins;

wherein a tape guide passage is formed between the outer member and the inner member to extend from the tape entry opening of the outer member to the tape exit slit, the tape guide passage including a tape folding portion adjoining the tape exit opening;

wherein the bottom wall of the outer member is formed with a tape advancing slot extending longitudinally between the tape entry opening and the tape exit slit;

wherein the inner core member has a larger width portion immediately below the pair of longitudinal grooves, and a smaller width portion immediately below the larger width portion; and wherein the larger width portion provides a pair of downwardly facing steps each of which extends generally in parallel to a bottom surface of the inner member.

2. The bias tape maker according to claim 1, wherein the tape advancing slot is longitudinally offset toward the tape exit slit of the outer member.

3. The bias tape maker according to claim 1, wherein each of the downwardly facing step extends more than half the length of the inner core member from the tape entry opening of the outer member.

4. The bias tape maker according to claim 1, wherein each of the steps is rounded at the tape entry opening of the outer member.

5. The bias tape maker according to claim 1, wherein the inner core member has a platform raised above the pair of roof margins of the outer member.

6. The bias tape maker according to claim 5, wherein the platform is flat and substantially horizontal, the platform being formed with a multiplicity of transverse ridges.

7. The bias tape maker according to claim 5, wherein the platform is flat and inclined upwardly toward the tape exit slit of the outer member, the platform being formed with a multiplicity of transverse ridges.

8. The bias tape maker according to claim 5, wherein the platform is curved upwardly toward the tape exit slit of the outer member.

9. The bias tape maker according to claim 1, wherein the inner core member has an entirely flat upper surface.

10. A bias tape maker comprising:

a thin walled outer member including a bottom wall, a pair of side walls extending upright form the bottom wall, and a pair of roof margins bent toward each other, the outer member having a tape entry opening and a tape exit slit; and an inner core member fitted in the outer member and having a pair of longitudinal grooves for receiving the pair of roof margins;

wherein a tape guide passage is formed between the outer member and the inner member to extend from the tape entry opening of the outer member to the tape exit slit, the tape guide passage including a tape folding portion adjoining the tape exit opening;

wherein the bottom wall of the outer member is formed with a tape advancing slot extending longitudinally between the tape entry opening and the tape exit slit;

wherein the outer member is tapered from the tape entry opening to the tape exit slit, the inner core member having a platform raised above the pair of roof margins of the outer member; and wherein the platform is flat and inclined upwardly toward the tape exit slit of the outer member, the platform being formed with a multiplicity of transverse ridges.

11. A bias tape maker comprising:

a thin walled outer member including a bottom wall, a pair of side walls extending upright from the bottom wall, and a pair of roof margins bent toward each other, the outer member having a tape entry opening and a tape exit slit; and an inner core member fitted in the outer member and having a pair of longitudinal grooves for receiving the pair of roof margins;

wherein a tape guide passage is formed between the outer member and the inner member to extend from the tape entry opening of the outer member to the tape exit slit, the tape guide passage including a tape folding portion adjoining the tape exit opening;

wherein the bottom wall of the outer member is formed with a tape advancing slot extending longitudinally between the tape entry opening and the tape exit slit;

wherein the outer member is tapered from the tape entry opening to the tape exit slit, the inner core member having a platform raised above the pair of roof margins of the outer member; and wherein the platform is curved upwardly toward the tape exit slit of the outer member.

* * * * *